US006042672A

United States Patent [19]

Kishine et al.

[11] Patent Number: 6,042,672

[45] Date of Patent: Mar. 28, 2000

[54] SEALED PAPER MAKING METHOD

[75] Inventors: Toshiaki Kishine; Mikio Yoshikawa; Toshikazu Yamada, all of Chiba-ken, Japan

[73] Assignee: Miyakoshi Printing Machinery Co., Ltd., Narashino, Japan

[21] Appl. No.: 09/033,717

[22] Filed: Mar. 3, 1998

[51] Int. Cl.[7] ..... B31F 1/00

[52] U.S. Cl. ..... 156/200; 156/204; 156/227; 156/269; 156/270; 156/277; 156/291; 229/92.1; 229/92.8; 229/800; 270/5.02; 270/39.05; 270/40; 270/41

[58] Field of Search ..... 156/204, 463, 156/200, 227, 277, 291, 269, 270, 252; 229/92.1, 92.8, 800; 283/36; 493/333, 356, 413; 270/5.01, 5.02, 40, 39.05, 41

[56] References Cited

U.S. PATENT DOCUMENTS

| | | | |
|---|---|---|---|
| 1,918,384 | 7/1933 | Falvey | 229/92.1 |
| 4,012,268 | 3/1977 | Johnsen | 156/200 |
| 5,449,156 | 9/1995 | Gnuechtel et al. | 270/5.02 |

FOREIGN PATENT DOCUMENTS

| | | |
|---|---|---|
| 458 024 | 11/1991 | European Pat. Off. . |
| 480 449 | 4/1992 | European Pat. Off. . |
| 2 431 983 | 2/1980 | France . |
| 62-7000 | 2/1987 | Japan . |

*Primary Examiner*—Deborah Jones
*Assistant Examiner*—Robert R. Koehler
*Attorney, Agent, or Firm*—Wenderoth, Lind & Ponack, L.L.P.

[57] ABSTRACT

In a method of making sealed paper, a web of paper is unrolled and fed, while under a given tension, from a paper roll, and is single-folded or multiple-folded. Prior to the or each folding step, the unrolled web of paper is treated by having an adhesive applied to margin portions thereof destined to be margins of the sealed paper on an inner surface thereof other than along a fold line at which the paper is to be folded. The folded web of paper is then cut to yield a number of sealable paper units so treated and folded as above. The method further includes pressing the sealable paper units to have them sealed with the adhesive applied and thereafter discharging the sealed paper units each of which represents a sealed paper. The method may further include printing a given message or information on a sheet of paper before the paper is rolled into the above mentioned paper roll.

6 Claims, 4 Drawing Sheets

SEALED PAPER MAKING METHOD

TECHNICAL FIELD

The present invention relates to a sealed paper making method and, more particularly, to a method of making a sealed paper continuously from an unrolled web of paper supplied from a paper roll and, typically single-folded in a V-shaped cross sectional configuration or double-folded in a Z-shaped cross sectional configuration. The sealed paper commonly has a pre-printed message or information sealed therein.

BACKGROUND ART

In a conventional method of making such a sealed paper, a sheet of paper to be single- or double-folded has, in a preliminary stage before it is rolled into a paper roll, been treated by applying, in a given pattern, a special adhesive as represented by a pressure sensitive adhesive to one of a pair of mutually opposing surfaces to be found in a web of paper unrolled from the paper roll after it is single-folded to provide a V-shaped cross sectional configuration or double-folded to provide a Z-shaped cross sectional configuration. The web of paper which has a message or information preliminarily printed thereon is unrolled from the paper roll and supplied to a folding machine where it is single- or double-folded as mentioned above. The folded web of paper is then sealed with the pair of the mutually opposing surfaces bonded together with the pressure sensitive adhesive, and thereafter, is cut into a number of sealed paper units each having a given size.

The conventional sealed paper making method described above has been found to be inefficient since it requires a pre-treatment operation in which a special adhesive is applied preliminarily in a given pattern for each individual sealed paper unit. Such pre-treatment operation must be carried out in a separate step on a sheet of paper before it is rolled into a paper roll which, in turn will provide an unrolled web of paper to be folded. The method is also characterized by poor production efficiency because a sealed paper must be made from a paper roll having a required pattern of adhesive preliminarily applied thereto, wherein a web of paper unrolled from the paper roll must, when it is to be folded at a given position, be registered in alignment in a top-to-bottom direction so that the folded web of paper may next be cut into a number of sealed paper units. This has required the web of paper to be synchronously fed at a limited feed rate with a pin tractor. It should further be pointed out that the above mentioned conventional sealed paper making method is disadvantageous in terms of costs coupled with the above noted poor efficiency since it must make use of a special adhesive such as a pressure sensitive adhesive which is expensive.

It is accordingly an object of the present invention to provide an improved method of making a sealed paper, which enables a number of sealed papers to be made with an increased efficiency and which also allows the use of an inexpensive adhesive, to thus make the method less costly.

SUMMARY OF THE INVENTION

In order to achieve the above mentioned object, there is provided in accordance with the present invention a method of making a sealed paper, which comprises the steps of: (a) feeding from a paper roll an unrolled web of paper with a given tension applied thereto; (b) folding the unrolled web of paper in the direction of its width in one or more folding steps; (c) prior to the one or each of the folding steps treating the unrolled web of paper by applying an adhesive to margin portions of a surface thereof which will be an inner surface when folded along a folding line, but not to a margin portion along the folding line (d) cutting the folded web of paper, so as to give rise to a number of sealable paper units (c); and pressing the sealable paper units to have them sealed with the applied adhesive, and discharging the sealed paper units.

According to the method described above, it can be seen and should be understood that because of the ability for a web of paper to be fed from a paper roll while under a given tension there is no need to employ a pin tractor as has been essential in the prior art, thus permitting a sealed paper to be made at an increased rate.

Also, by virtue of the fact that the application of an adhesive is designed to be carried out immediately prior to the or each folding step, it can be seen and should be understood that there is no need to perform a separate adhesive applying step before a sheet of paper, i.e., typically with a required message or information preliminarily printed thereon, is rolled into a paper roll for use later in feeding a web of paper to be folded. This permits the preparation of a sealed paper with enhanced efficiency.

It can also be seen and should be understood that this improved method allows the use of an aqueous adhesive and since a pattern gluing machine, a pasting head and a nozzle type paste applying machine can then be conveniently used, allows a sealed paper of the type described to be made at a reduced cost.

In accordance with a specific feature of the present invention for a method of making a sealed paper, the unrolled web of paper is single-folded after an adhesive has been applied. Alternatively, the paper can be double-folded, with one fold being made after a first adhesive application and a second fold being made after a second adhesive application.

In accordance with another specific feature of the present invention, a method of making a sealed paper may further comprise the step of applying a printed message or printed information to be sealed on a sheet of paper before being rolled to provide the above mentioned paper roll.

BRIEF DESCRIPTION OF THE DRAWINGS

The present invention will better be understood from the following detailed description and the drawings attached hereto showing certain illustrative embodiments of the present invention. In this connection, it should be noted that such embodiments as illustrated in the accompanying drawings are intended in no way to limit the present invention but to facilitate an explanation and understanding thereof.

In the accompanying drawings.

PREFERRED EMBODIMENTS OF THE INVENTION

Hereinafter, suitable embodiments of the present invention with respect to a method of making a sealed paper will be set forth in detail with reference to the accompanying drawings.

Figure 1:
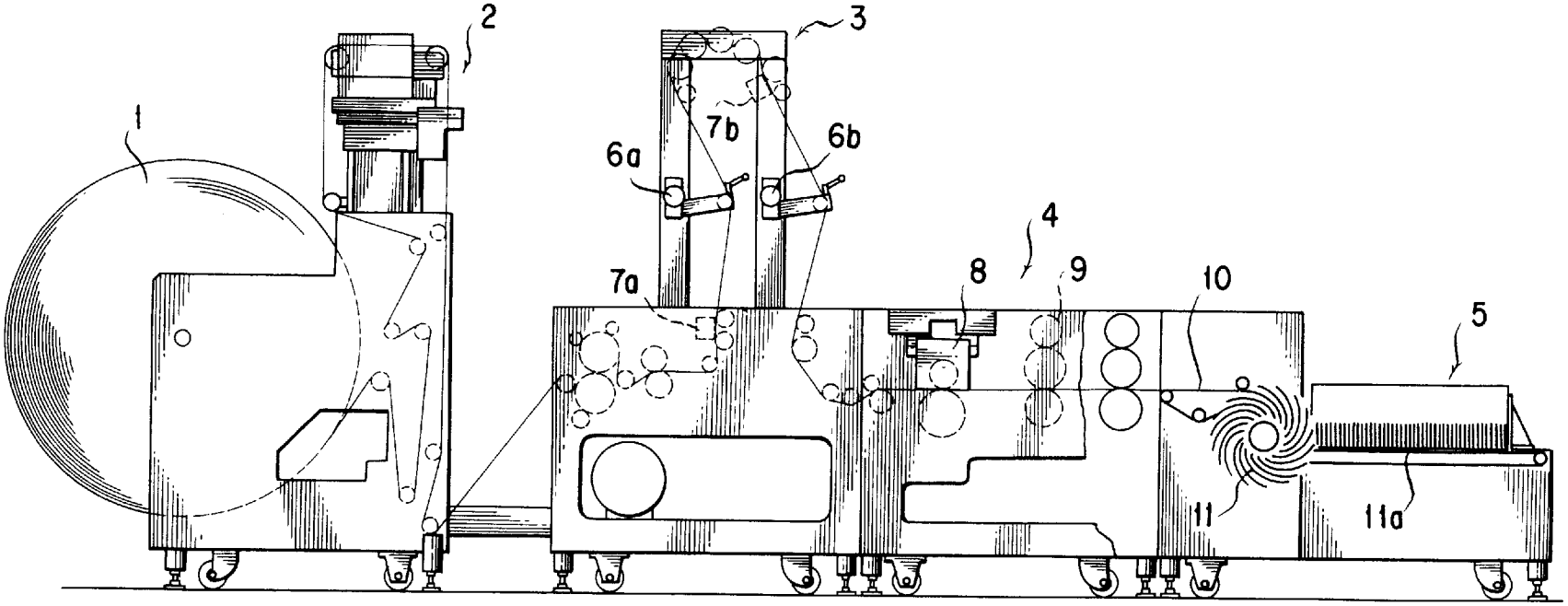
FIG. 1 is a front elevational view diagrammatically illustrating the construction of an apparatus for carrying out a method according to the present invention.
Figure 2:
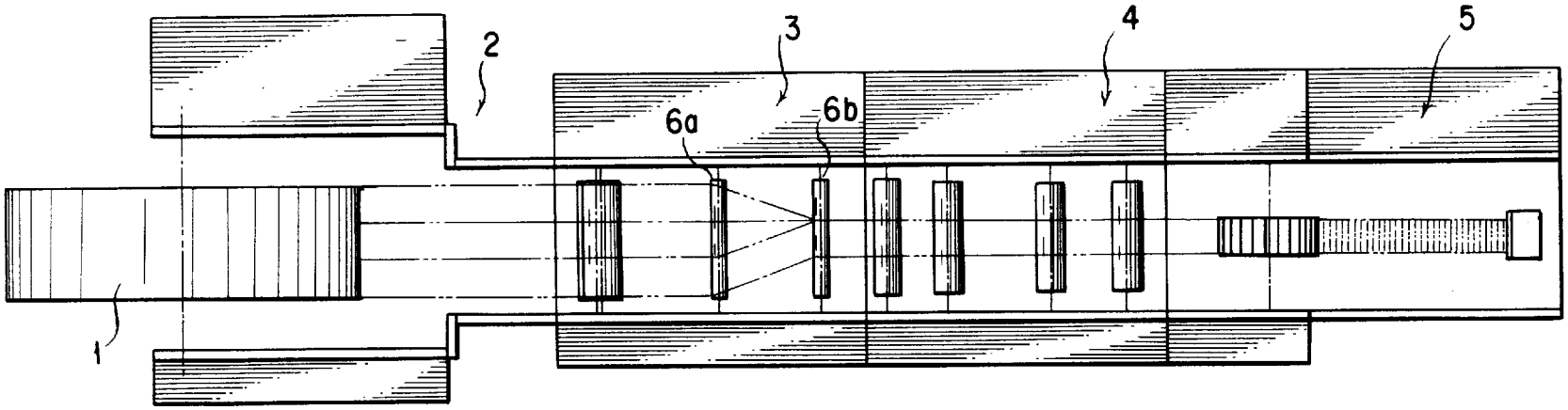
FIG. 2 is a top plan view that diagrammatically shows a method according to the present invention.

Referring now to FIG. 1, there is shown an apparatus for making a sealed paper in which a web of paper unrolled from a paper roll 1 is singled-folded or double-folded in the direction of its width to provide a V-shaped or Z-shaped cross sectional configuration, respectively. The apparatus includes a feed section 2, a folding section 3, a working section 4 and a stacker section 5 which are disposed successively in the direction of travel of the unrolled web of paper.

The feed section 2 is designed to support the paper roll 1 and, when the web of paper is fed from the roll 1, acts to apply a tension to it so as to maintain the paper web at a substantially constant tension. The folding section 3 includes a first plow folding device 6*a* and a second plow folding device 6*b*as well as a first adhesive applying device 7*a* and a second adhesive applying device 7*b*.

Figure 3:
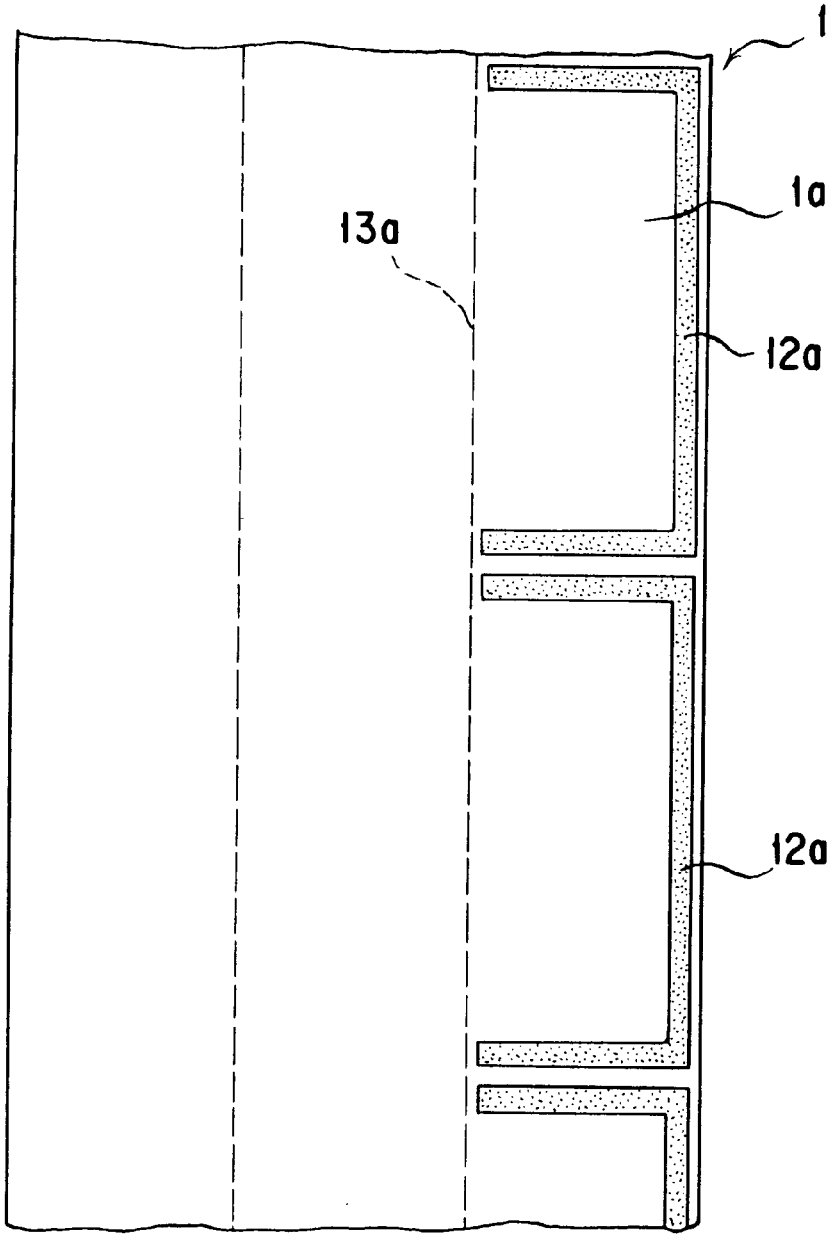
FIG. 3 is an explanatory view that diagrammatically illustrates a first adhesive applying pattern where a web of paper unrolled from a paper roll is double-folded into a Z-shaped cross sectional configuration.
Figure 4:
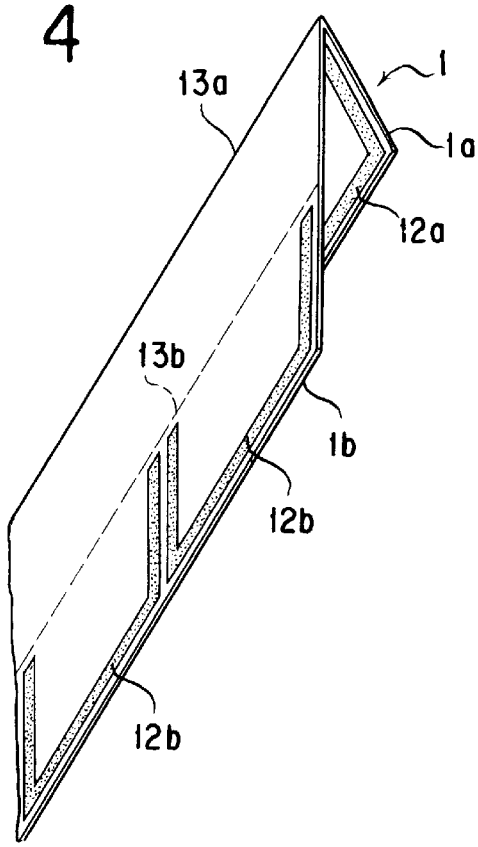
FIG. 4 is an explanatory view that diagrammatically illustrates a first folding pattern and a second adhesive-applying pattern where the an unrolled web of paper is double-folded into the Z-shaped cross sectional configuration.
Figure 5:
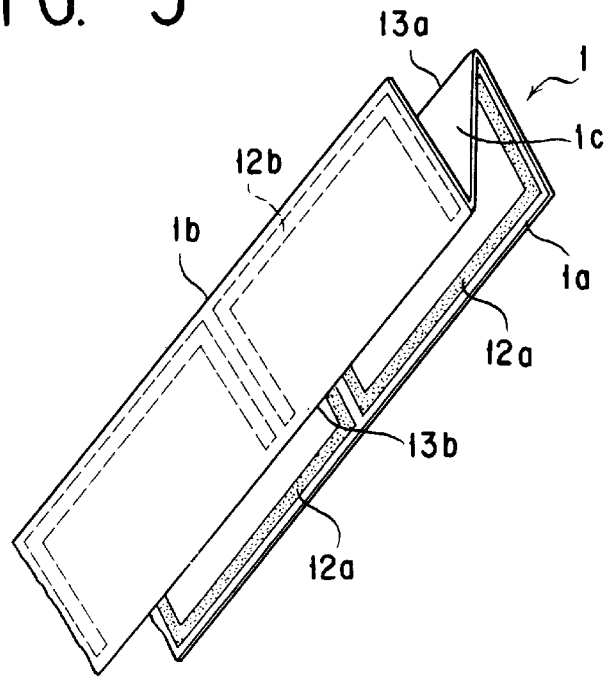
FIG. 5 is an explanatory view that diagrammatically illustrates a second folding pattern where an unrolled web of paper is double-folded into the Z-shaped cross sectional configuration.

The first plow folding device 6*a* acts to fold the unrolled web of paper fed from the feed section 2 in the direction of its width to provide a folded web of paper having a V-shaped cross sectional fold configuration. The second plow folding device 6*b* is disposed downstream of the first plow folding device 6*a* and acts to further fold the V-folded web of paper from the first device 6*a* to provide a doubly V-folded web of paper having a Z-shaped cross sectional configuration. The two adhesive applying devices 7*a* and 7*b* are disposed upstream of the first and second plow folding devices 6*a* and 6*b*, respectively, and are each designed to apply an adhesive to margin portions of the unrolled web of paper (i.e. portions which are destined to be margins of a sealed paper), on a surface thereof which becomes an inner surface when folded along a fold line. However, the adhesive is not applied in an area adjacently along the fold line (as illustrated in FIGS. 3–5).

The working section 4 includes a cutter device 8 and a pressing device 9. The cutter device 8 is designed to cut the web of paper that is folded in a V-shaped cross sectional fold configuration or in a Z-shaped cross sectional fold configuration, so as to yield a number of sealable paper units with adhesive applied and folded as described above. The pressing device 9 serves to press the sealable paper units to have them sealed by the above mentioned adhesive. The stacker section 5 includes a feed belt 10, a settling roll 11 and a stacker 11*a*.

An explanation will now be given with respect to an operation of making a sealed paper with a Z-shaped cross sectional fold configuration using the apparatus described above.

A web of paper is unrolled from the paper roll 1 and fed from the feed section 2 under a given tension applied through a series of rollers disposed in the folding section 3. The web of paper thus rendered taut is advanced through the folding section 3 to first have an adhesive applied, as shown in FIG. 3, to portions thereof which are destined to be the shaped margins of sealed papers, on the inner surfaces thereof that lie within a one third fold section 1*a* in the direction of width of the web of paper 1 successively in a series of first patterns 12*a*. This adhesive pattern 12*a* is shown here in the form of a rectangle that is open to the side of the paper web which is destined to contain a first fold line 13*a*. Thus, the adhesive is applied to the folding web section la along the portions of the paper web destined to be the margins of the final sealed papers, excluding the areas destined to contain the first fold line 13*a*.

Next, the web of paper 1 is folded along the planned first fold line 13*a*as shown in FIG. 4, using the first plow folding device 6*a*.

Next, using the second adhesive applying device 7*a* the adhesive is applied, as shown in FIG. 4, in the series (here shown by a pair) of second patterns 12*b* to portions thereof which are destined to be the shaped margins of sealed papers, on the inner surfaces thereof that lie within the other one third fold section 1*b* in the direction of width of the web of paper 1. This adhesive pattern 12*b* is again in the form of a rectangle that is open to the side of the paper web which is destined to contain a second fold line 13*b*. Thus, the adhesive is applied to the folding web section 1*b* along the portions of the paper web destined to be the margins of sealed papers to be made, excluding the areas destined to contain the second fold line 13*b*.

Next, using the second plow folding device 6*b*the web of paper 1 is folded along the second fold line 13*b* as shown in FIG. 5.

Thereafter, the web of paper that has been folded in the folding section 3 to have a Z-shaped cross sectional configuration is cut using the cutter device 8 so as to yield a number of sealable paper units which are then pressed using the pressing device 9 to bond the fold sections l*a* and l*b* to a fold body section l*c* and to have the sealable paper units sealed, thereby providing the number of sealed papers which are successively accumulated on the stacker section 5.

In a manner as described above, it can be seen that a multitude of sealed papers folded in a Z-shaped cross sectional fold configuration will be made continuously.

It should be noted at this point that a given message or information to be sealed as needed may be printed on a sheet of paper before the paper is rolled to provide the paper roll 1, in an area that corresponds to a given inner region of the sealed paper. In this case, a need exists that an area where the printing is applied and, an area where the web of paper is folded should be registered in alignment in a top-to-bottom direction as well as in a transverse direction.

Also, in case a fold with a V-shaped cross sectional configuration is desired, either of the two adhesive applying devices and the two plow folding devices should be used and the unrolled web of paper 1 folded at a center line thereof.

It should also be noted that the adhesive to be applied by the devices 7*a* and 7*b* may conveniently be an aqueous one of a usual type. Further, the pattern in which the adhesive is applied may be rectilinear or may alternatively be dotted in the form a multitude of dots finely spaced or with a pitch on the order of mm.

Thus, in accordance with the present invention, it can be seen and should be understood that there is provided an improved method of making a sealed paper whereby, because of the ability for a web of paper while under a given tension to be fed from a paper roll, it is not necessary to employ a pin tractor as has been essential in the prior art, thus permitting sealed paper to be made at an increased rate.

Also, by virtue of the fact that the application of an adhesive is designed to be carried out immediately prior to the or each folding step, it can be seen and should be understood that there is no need to perform a separate adhesive applying step before a sheet of paper, i.e., typically with a required message or information printed thereon, is rolled to provide a paper roll for use in feeding a web of paper to be folded, thus permitting the making of a sealed paper with enhanced efficiency.

It can also be seen and should be understood that this improved method allows the use of an aqueous adhesive and since a pattern gluing machine, a pasting head and a nozzle type paste applying machine can then be conveniently used, allows a sealed paper of the type described to be made at a reduced cost. The use of a pattern gluing machine can be recommended to achieve effects in terms of economy and versatility. The use of a nozzle type machine is likewise advisable in order to render the entire equipment smaller in size and compact.

It should further be noted that in making a sealed paper from an unrolled web of paper in accordance with the present invention, a paper roll 1 can be employed that has been rolled from a sheet of paper on which desired information or message has been printed. This feature allows the printing to be performed on an on-line or off-line basis, thereby permitting a multitude of sealed papers to be made in a single process.

While the present invention has hereinbefore been set forth with respect to certain illustrative embodiments thereof, it will readily be appreciated by a person skilled in the art to be obvious that many alterations thereof, omissions therefrom and additions thereto can be made without departing from the essence and the scope of the present invention. Accordingly, it should be understood that the present invention is not limited to the specific embodiments thereof set out above, but includes all possible embodiments thereof that can be made within the scope with respect to the features specifically set forth in the appended claims and encompasses all the equivalents thereof.

What is claimed is:

1. A method of making sealed paper units having plural plies adhered together along margin portions thereof, said method comprising:

supplying a web of paper under tension along a longitudinal direction of the web of paper by unrolling the web of paper from a paper roll under a given tension applied to the web of paper by a series of rollers;

treating said web of paper, unrolled from said paper roll and under tension applied by said series of rollers, by applying adhesive thereto along portions thereof which will become margin portions of the sealed paper units;

immediately after said treating of said web of paper by applying adhesive thereto, folding said web of paper in a width direction thereof along a longitudinal folding line which separates a first fold section from a second fold section;

after said folding of said web of paper, cutting said web of paper to produce plural sealable paper units; and after said cutting of said web of paper into sealable paper units, pressing said first and second fold sections of each of said sealable paper units against each other to form said sealed paper units.

2. A method as set forth in claim 1 further comprising prior to said supplying of said web of paper from said paper roll, applying a printed message or printed information on said web of paper and rolling said web of paper to form said paper roll.

3. A method as set forth in claim 1 wherein in said applying of adhesive to said web of paper, said adhesive is applied in adhesive patterns spaced longitudinally along said first fold section of said web of paper, each of said adhesive patterns including a pattern portion along a longitudinally extending edge of said web of paper and pattern portions extending in a width direction but no pattern portion extending along said longitudinal folding line.

4. A method of making sealed paper units having plural plies adhered together along margins thereof, said method comprising:

supplying a web of paper under tension along a longitudinal direction of the web of paper by unrolling the web of paper from a paper roll under a given tension applied to the web of paper by a series of rollers;

treating said web of paper, unrolled from said paper roll and under tension applied by said series of rollers, by applying adhesive thereto along first portions thereof which will become margin portions of the sealed paper units;

immediately after said treating of said web of paper by applying adhesive thereto along said first portions thereof, folding said web of paper in a width direction thereof along a first longitudinal folding line which separates a first fold section from a second fold section;

after said folding of said web of paper along said first longitudinal folding line, treating said web of paper by applying adhesive thereto along second portions thereof which will become margin portions of the sealed paper units;

immediately after said treating of said web of paper by applying adhesive thereto along said second portions thereof, folding said web of paper in a width direction thereof along a second longitudinal folding line which separates said second fold section from a third fold section;

after said folding of said web of paper along said second longitudinal folding line, cutting said web of paper to produce plural sealable paper units; and after said cutting of said web of paper into sealable paper units, pressing said first, second and third fold sections of each of said sealable paper units against each other to form said sealed paper units.

5. A method as set forth in claim 4 further comprising prior to said supplying of said web of paper from said paper roll, applying a printed message or printed information on said web of paper and rolling said web of paper to form said paper roll.

6. A method as set forth in claim 4 wherein in said applying of adhesive to said web of paper along first portions thereof, said adhesive is applied in first adhesive patterns spaced longitudinally along said first fold section of said web of paper, each of said first adhesive patterns including a pattern portion along a first longitudinally extending edge of said web of paper and pattern portions extending in a width direction but no pattern portion extending along said first longitudinal folding line; and in said applying of adhesive to said web of paper along second portions thereof, said adhesive is applied in second adhesive patterns spaced longitudinally along said third fold section of said web of paper, each of said second adhesive patterns including a pattern portion along a second longitudinally extending edge of said web of paper and pattern portions extending in a width direction but no pattern portion extending along said second longitudinal folding line.

* * * * *